US006597795B1

(12) United States Patent
Swenson

(10) Patent No.: US 6,597,795 B1
(45) Date of Patent: Jul. 22, 2003

(54) DEVICE TO IMPROVE LOUDSPEAKER ENCLOSURE DUCT

(75) Inventor: Stephen Swenson, 3679 Levadia Street, Gloucester, Ontario (CA), K1T 1L6

(73) Assignee: Stephen Swenson, Gloucester (CA)

( * ) Notice: Subject to any disclaimer, the term of this patent is extended or adjusted under 35 U.S.C. 154(b) by 0 days.

(21) Appl. No.: 09/199,158

(22) Filed: Nov. 25, 1998

(51) Int. Cl.[7] ..... H04R 1/20
(52) U.S. Cl. ..... 381/349; 181/156
(58) Field of Search ..... 381/349, 98, 338, 381/345, 346, 348, 353, FOR 146, FOR 145; 181/156, 155, 199, 198

(56) References Cited

U.S. PATENT DOCUMENTS 4,126,204 A * 11/1978 Ogi et al. ..... 181/156
4,210,778 A * 7/1980 Sakurai et al. ..... 179/1
5,606,297 A * 2/1997 Phillips ..... 333/141
5,689,573 A * 11/1997 Jones ..... 381/154

FOREIGN PATENT DOCUMENTS

JP 401289399 * 11/1989 ..... 381/FOR 146
JP 404114598 * 11/1989 ..... 381/FOR 146
JP 404336793 * 11/1992 ..... 381/FOR 146

* cited by examiner

*Primary Examiner*—Curtis Kuntz
*Assistant Examiner*—Lun-See Lao
(74) *Attorney, Agent, or Firm*—Paul S. Sharpe; Ogilvy Renault

(57) ABSTRACT

A waveguide for use in a loudspeaker. The waveguide is positioned within a loudspeaker enclosure and connect to a low frequency transport duct of the loudspeaker. The waveguide has a hollow body which is perforated with apertures. The body presents a high mechanical impedance to the low frequency waves increasing the duct input impedance of the loudspeaker which improves transmission of the low frequency waves to the exterior of the loudspeaker enclosure.

11 Claims, 3 Drawing Sheets

DEVICE TO IMPROVE LOUDSPEAKER ENCLOSURE DUCT

FIELD OF THE INVENTION

The present invention relates to a device to improve a loudspeaker enclosure duct and more particularly, the present invention relates to a device for the transfer of low frequency energy from within the speaker enclosure to the exterior of the enclosure.

BACKGROUND OF THE INVENTION

Loudspeaker technology in the prior art has proposed many devices and methods to enhance sonic performance. One of the most important frequency ranges is the low end range between 30 Hz and 100 Hz. This frequency range is often delivered from a loudspeaker enclosure through an opening in the front baffle of the enclosure. As such, much of the sound at this frequency remains trapped within the enclosure leading to degradation of the overall sound experienced by the listener.

Other arrangements in known loudspeakers provide a conduit or port extending within the enclosure to the opening. Although generally useful, these devices do not substantially augment the output of the lower frequencies.

SUMMARY OF THE INVENTION

One object of the present invention is to provide an arrangement for enhancing the electromotive properties of a loudspeaker port to improve the transfer of low frequency sound energy from within the loudspeaker enclosure to a listening area.

A further object of the present invention is to provide a device for enhancing the quality of low frequency sound exiting a loudspeaker port, comprising:

a waveguide adapted to be coupled to a loudspeaker duct, the waveguide having a hollow enclosed body composed of a rigid and nonresonant material and including a plurality of slots in the body, whereby the slots present mechanical impedance to low frequency sound waves passing through the body for increasing the transfer of the sound waves from within a loudspeaker enclosure through the port.

The waveguide may comprise any suitable material of a rigid, nonresonant form. Examples include paperboard, plastic, metal, composite materials among others. Rigidity is desirable to reduce tonal coloration to the sound waves which would otherwise degrade sonic quality.

A further object of one embodiment of the present invention is to provide a device for enhancing the quality of low frequency sound exiting a loudspeaker port of a loudspeaker comprising in combination:

a loudspeaker having an enclosure, speakers and a port for the passage of low frequency sound waves from within the enclosure to a point exterior thereof, the port including a hollow duct extending therefrom for transferring the low frequency sound waves from within the enclosure to the port; and a waveguide coupled to the duct, the waveguide having a hollow enclosed body composed of a rigid and nonresonant material and including a plurality of slots in the body, whereby the slots present mechanical impedance to the low frequency sound waves passing through the body for increasing the transfer of the sound waves from within a loudspeaker enclosure through the port.

The shape of the waveguide is not a critical feature; any hollow enclosure shape may be employed. With respect to the slots, the position these occupy on the waveguide may take any pattern.

In terms of specific dimensions, the waveguide dimensions will vary depending on the size (internal volume of the loudspeaker enclosure).

A still further object of one embodiment of the present invention is a device for enhancing the quality of low frequency sound exiting a loudspeaker port of a loudspeaker comprising, in combination:

a loudspeaker having an enclosure, speakers and a port for the passage of low frequency sound waves from within the enclosure to a point exterior thereof;

a waveguide, the waveguide having a hollow enclosed body composed of a rigid and nonresonant material and including a plurality of slots in the body; and a hollow duct coupled to the waveguide and to the port for transferring the low frequency sound waves from within the enclosure to the port, whereby the slots present mechanical impedance to the low frequency sound waves passing through the body for increasing the transfer of the sound waves from within a loudspeaker enclosure through the port.

Having thus described the invention, reference will now be made to the accompanying drawings illustrating preferred embodiments.

BRIEF DESCRIPTION OF THE DRAWINGS

Similar numerals in the figures denote similar elements.

DETAILED DESCRIPTION OF THE PREFERRED EMBODIMENTS

Figure 1:
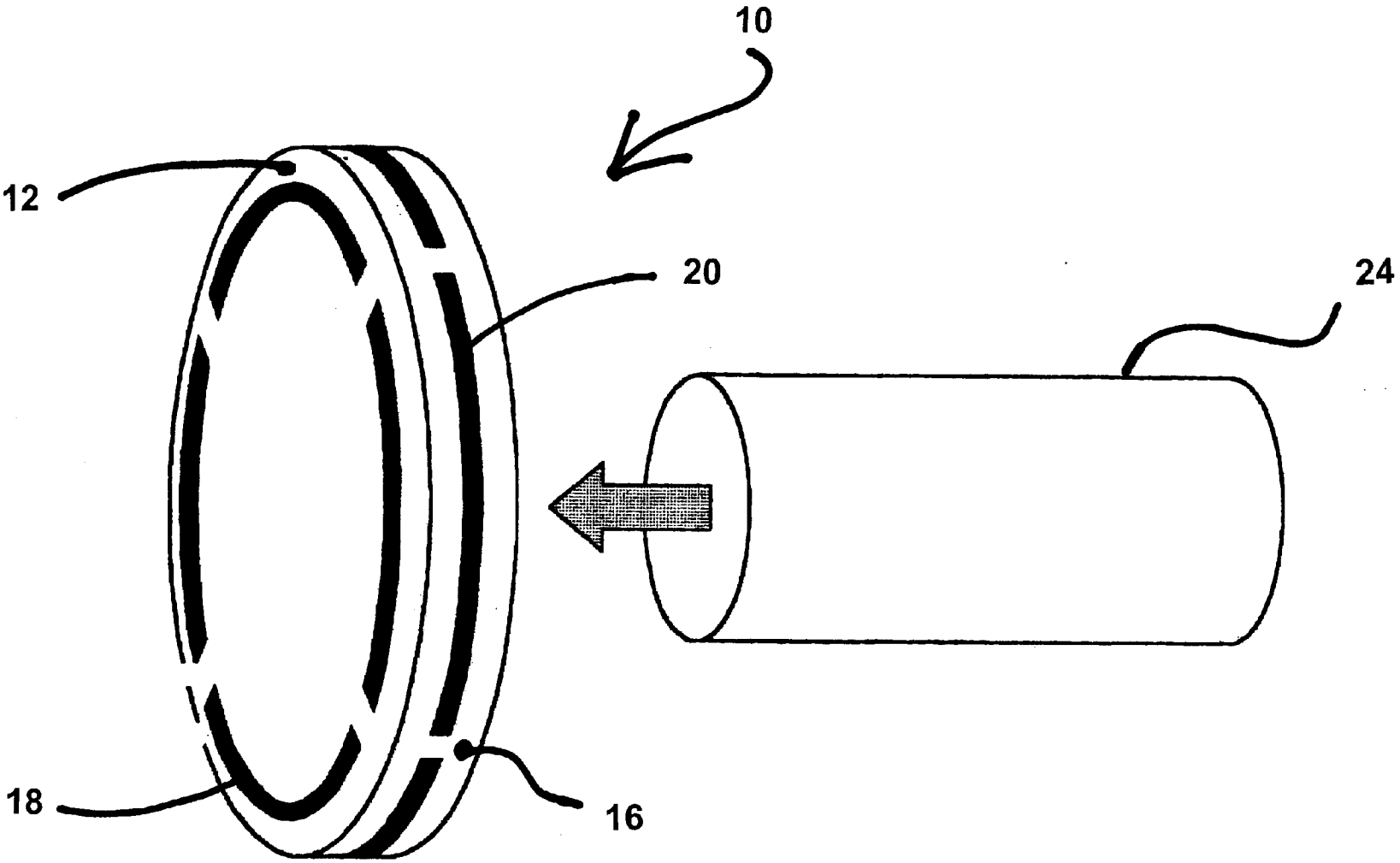
FIG. 1 is a schematic illustration of one embodiment of the present invention.
Figure 2:
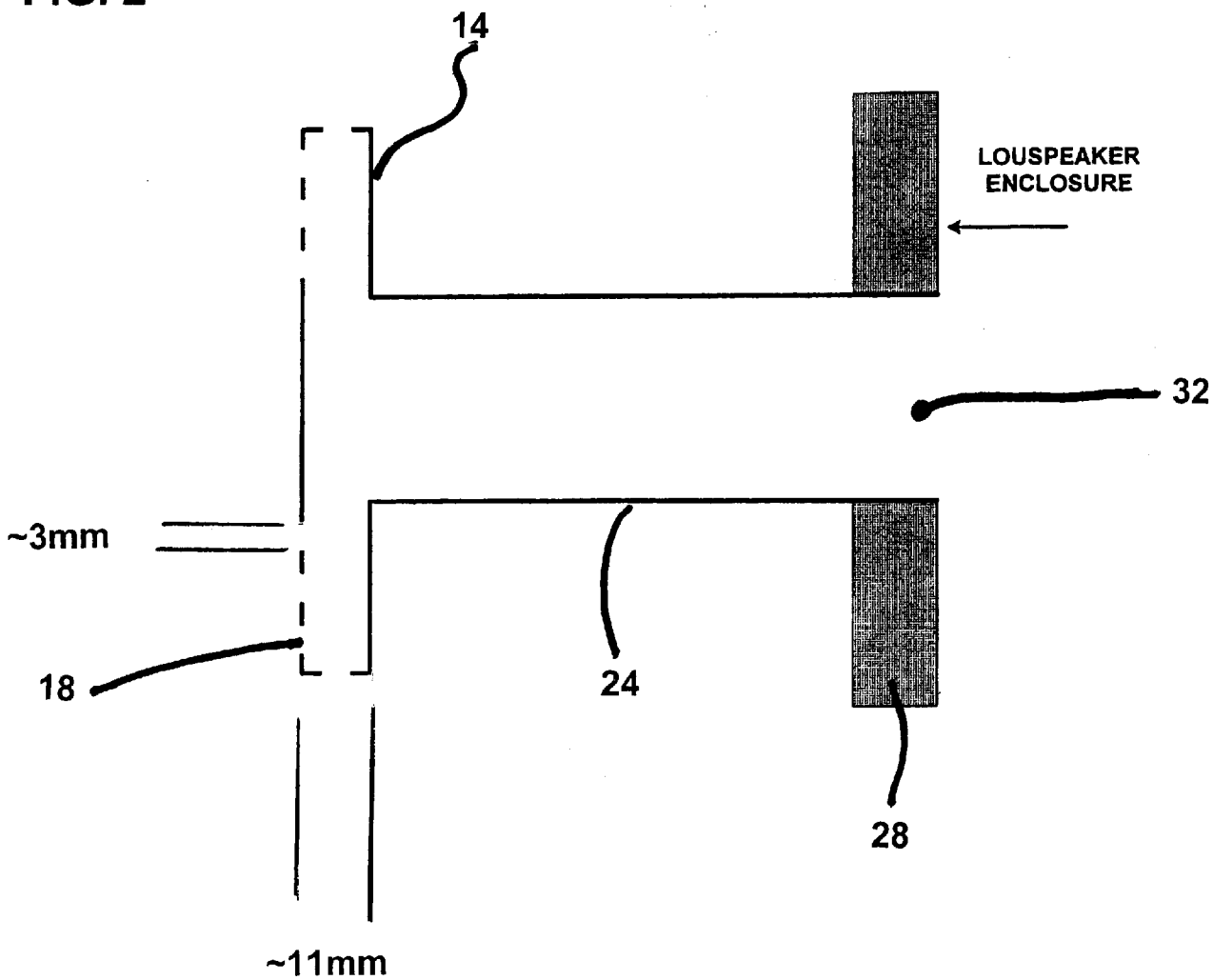
FIG. 2 is a cross-section of the device according to one embodiment of the present invention.

Referring now to the drawings, FIGS. 1 and 2 illustrate a first embodiment of the device. Numeral 10 denotes the waveguide, shown in the example as a hollow disk having a front face 12, rear face 14 and peripheral wall 16. Front face 12 includes, as shown in the example, a plurality of coaxially and spaced apart arcuate slots 18. Peripheral wall 16 also includes spaced apart arcuate slots 20. Rear face 14 includes a hollow projection 22 for connection to a duct 24 (shown best in FIG. 3).

Figure 3:
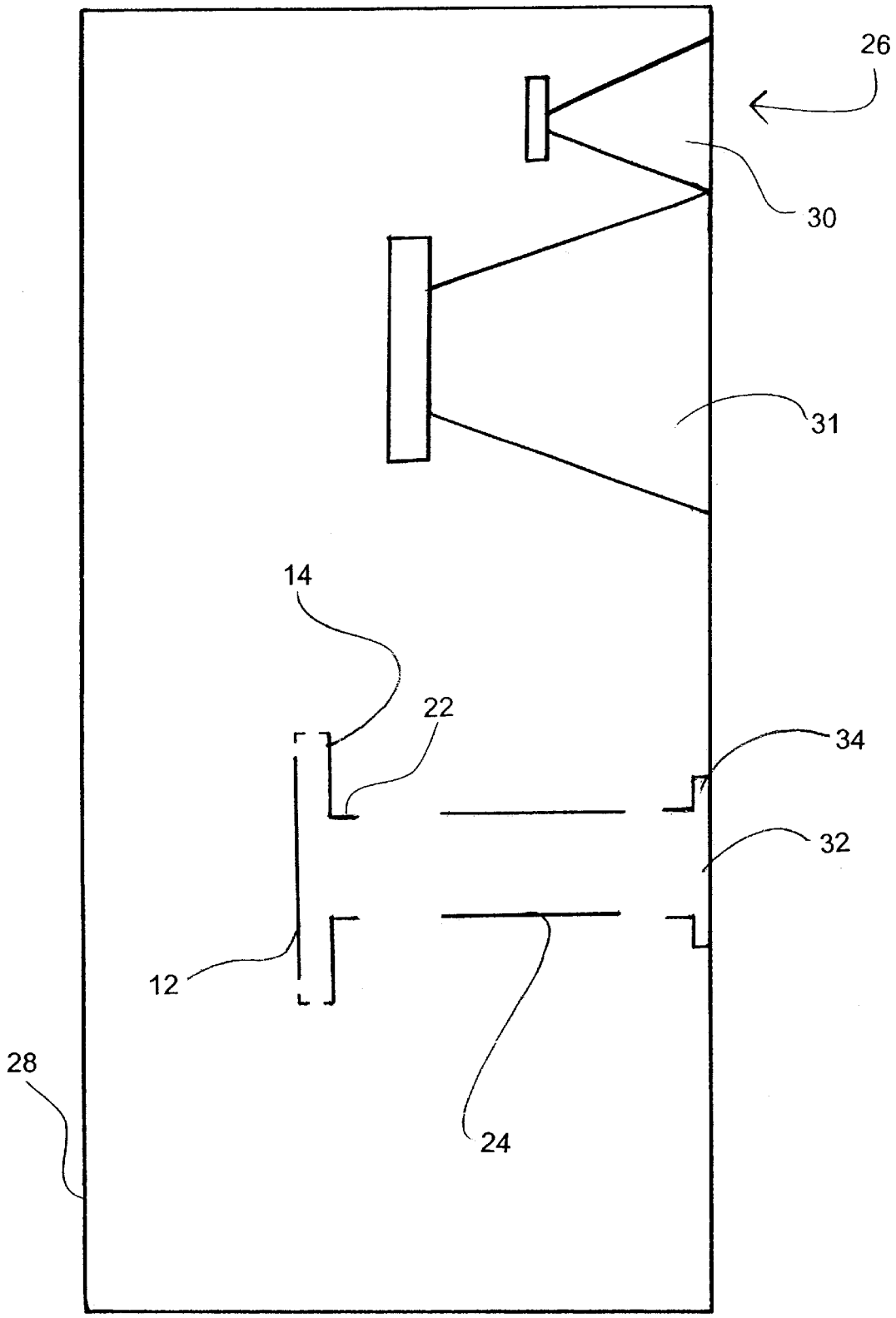
FIG. 3 is a cross-section of the device as positioned in a conventional loudspeaker.

In FIG. 3, duct 24 is a hollow tube typically associated with a conventional loudspeaker, the latter being designated by numeral 26 and including an enclosure 28, speaker units 30 and 31 and a low frequency port or opening 32 for permitting passage of low frequency energy from within the enclosure 28 to an exterior point. The duct 24 extends from port 32 for connection with projection 22 of waveguide 10. In this example, the duct is integral with the loudspeaker enclosure 28.

Further, in reference to FIG. 3, the duct may be absent in the loudspeaker enclosure 28 and the duct 24 may thus comprise a separate element or be integral with the waveguide 10. In this variation, port 32 may include a projection 34, similar to projection 22 of the waveguide 10. Connection between the elements 22, 24 and 34 may be achieved by simple friction fit, adhesives or other suitable fastening means.

It has been found that the most efficient transfer of low frequency transmission from within the enclosure 28 through to port 32 is achieved when the ratio of the depth of the waveguide body relative to the slot width is 4:1 as illustrated in FIG. 2. As an example, the depth of the body may be 0.5 inches and the slot width 0.125 inches. Specific dimensions will vary depending on the internal volume of the loudspeaker enclosure. As a guide, the total slot length should be approximately equal to the circumference of speaker 30.

In use, the waveguide increases the mechanical impedance of low frequency sound waves typically between 30 Hz and 100 Hz experienced by the sound waves prior to passage through the duct to the port. Accordingly, the electro mechanical impedance of the duct is increased by the waveguide. This, in turn, enhances transmission of the low frequency sound from the speaker to the duct. This has the effect of broadening the acoustic sound stage thus adding additional atmosphere and depth to the sound delivered to a listener.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A device for enhancing the quality of low frequency sound exiting a loudspeaker port, comprising:

a waveguide adapted to be coupled to a loudspeaker duct, said waveguide having a hollow enclosed disk shaped body composed of a rigid and nonresonant material and including a plurality of arcuate slots in said body, said body having a depth dimension and said slots have a width dimension, said depth relative to said width being in a ratio of 4:1, whereby said slots present mechanical impedance to low frequency sound waves passing through said body for increasing the transfer of said sound waves from within a loudspeaker enclosure through said port.

2. The device as set forth in claim 1, wherein said enclosed body of said waveguide includes a front face and a rear face, said rear face including an aperture for connection to a loudspeaker port, said rear face being devoid of said slots.

3. The device as set forth in claim 1, wherein said arcuate slots are arranged in coaxial spaced relation.

4. The device as set forth in claim 1, wherein said disk includes a plurality of spaced apart slots about the periphery.

5. A device for enhancing the quality of low frequency sound exiting a loudspeaker port of a loudspeaker comprising, in combination:

a loudspeaker having an enclosure, speakers and a port for the passage of low frequency sound waves from within said enclosure to a point exterior thereof, said port including a hollow duct extending therefrom for transferring said low frequency sound waves from within said enclosure to said port; and a waveguide coupled to said duct, said waveguide having a hollow enclosed disk shaped body composed of a rigid and nonresonant material and including a plurality of arcuate slots in said body, said body having a depth dimension and said slots have a width dimension, said depth relative to said width being in a ratio of 4:1, whereby said slots present mechanical impedance to said low frequency sound waves passing through said body for increasing the transfer of said sound waves from within a loudspeaker enclosure through said port.

6. The device as set forth in claim 5, wherein said enclosed body of said waveguide includes a front face and a rear face, said rear face including an aperture for connection to a loudspeaker port, said rear face being devoid of said slots.

7. The device as set forth in claim 5, wherein said arcuate slots are arranged in coaxial spaced relation.

8. The device as set forth in claim 5, wherein said disk includes a plurality of spaced apart slots about the periphery.

9. A device for enhancing the quality of low frequency sound exiting a loudspeaker port of a loudspeaker comprising, in combination:

a loudspeaker having an enclosure, speakers and a port for the passage of low frequency sound waves from within said enclosure to a point exterior thereof;

a waveguide, said waveguide having a hollow enclosed disk shaped body composed of a rigid and nonresonant material and including a plurality of arcuate slots in said body, said body having a depth dimension and said slots have a width dimension, said depth relative to said width being in a ratio of 4:1; and a hollow duct coupled to said waveguide and to said port for transferring said low frequency sound waves from within said enclosure to said port, whereby said slots present mechanical impedance to said low frequency sound waves passing through said body for increasing the transfer of said sound waves from within a loudspeaker enclosure through said port.

10. The device as set forth in claim 9, wherein said enclosed body of said waveguide includes a front face and a rear face, said rear face including an aperture for connection to a loudspeaker port, said rear face being devoid of said slots.

11. The device as set forth in claim 9, wherein said arcuate slots are arranged in coaxial spaced relation.

* * * * *